US007278405B2

(12) United States Patent
Takahashi

(10) Patent No.: US 7,278,405 B2
(45) Date of Patent: Oct. 9, 2007

(54) FUEL INJECTION SYSTEM DESIGNED TO ENSURE ENHANCED RELIABILITY OF DIAGNOSIS OF VALVE

(75) Inventor: Tomohiro Takahashi, Kariya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/543,214

(22) Filed: Oct. 5, 2006

(65) Prior Publication Data

US 2007/0079808 A1 Apr. 12, 2007

(30) Foreign Application Priority Data

Oct. 6, 2005 (JP) ..... 2005-293153

(51) Int. Cl.
*F02M 37/00* (2006.01)

(52) U.S. Cl. ..... 123/514; 123/447; 123/688; 73/119 A; 73/118.1

(58) Field of Classification Search ..... 123/447, 123/514, 688; 73/119 A, 118.1
See application file for complete search history.

(56) References Cited

U.S. PATENT DOCUMENTS 5,319,572 A * 6/1994 Wilhelm et al. ..... 702/51
5,493,902 A * 2/1996 Glidewell et al. ..... 73/119 A
5,715,786 A * 2/1998 Seiberth ..... 123/198 D
6,293,251 B1 * 9/2001 Hemmerlein et al. ..... 123/447
6,792,919 B2 * 9/2004 Kohketsu et al. ..... 123/447
6,889,666 B2 * 5/2005 Oono ..... 123/514
7,137,294 B2 * 11/2006 Eser et al. ..... 73/119 A
2002/0092504 A1 * 7/2002 Kohketsu et al. ..... 123/447
2006/0243244 A1 * 11/2006 Kasbauer et al. ..... 123/333

FOREIGN PATENT DOCUMENTS

JP 2004-11448 1/2004

* cited by examiner

*Primary Examiner*—Stephen K. Cronin
*Assistant Examiner*—J. Page Hufty
(74) *Attorney, Agent, or Firm*—Nixon & Vanderhye P.C.

(57) ABSTRACT

A fuel injection system for automotive diesel engine is provided which is equipped with a fuel pressure sensor working to measure the pressure of fuel in an accumulator and a pressure-reducing valve working to drain the fuel from the accumulator. The system is designed to ensure enhanced reliability of diagnosis of the pressure-reducing valve. The system works to make a temporal diagnosis of the pressure-reducing valve based on the behavior of the pressure in the accumulator upon opening of the pressure-reducing valve after an ignition switch is turned off. After elapse of a given period of time, when it is determined that a value of the pressure in the accumulator, as measured by the fuel pressure sensor, lies near the atmospheric pressure, the system determines that the fuel pressure sensor is operating properly and fixes the temporal diagnosis of the pressure-reducing valve ultimately.

18 Claims, 13 Drawing Sheets

IGNITION S.W.
ON
OFF

PRESSURE-REDUCING VALVE
OPEN
CLOSED

FUEL PRESSURE
ΔP1
ΔT
ATMOSPHERIC PRESSURE

FUEL PRESSURE
ATMOSPHERIC PRESSURE

FUEL PRESSURE
ΔP1
ΔT
ATMOSPHERIC PRESSURE
ΔP2
t1
t2
t3
t4

FUEL INJECTION SYSTEM DESIGNED TO ENSURE ENHANCED RELIABILITY OF DIAGNOSIS OF VALVE

CROSS REFERENCE TO RELATED DOCUMENT

The present application claims the benefit of Japanese Patent Application No. 2005-293153 filed on Oct. 6, 2005, the disclosure of which is incorporated herein by reference.

BACKGROUND OF THE INVENTION

1. Technical Field of the Invention

The present invention relates generally to an accumulator fuel injection system equipped with a fuel pressure sensor working to measure the pressure of fuel within an accumulator such as a common rail and a pressure-reducing valve working to reduce the pressure in the accumulator, and more particularly to such a system designed to ensure enhanced reliability of diagnosis of the pressure-reducing valve.

2. Background Art

Automotive fuel injection systems are known which are equipped with an accumulator (also called a common rail) working to supply fuel at high pressure to fuel injectors each for one of cylinders of a diesel engine. Such common rail fuel injection systems are typically designed to control the pressure of fuel in the common rail to be fed to the fuel injectors as a function of operating conditions of the engine.

Specifically, the common rail fuel injection systems typically work to determine a target pressure of fuel in the common rail based on an effort of a vehicle driver on an accelerator pedal and a target quantity of fuel to be injected into the engine and bring a measured value of the pressure of fuel in the common rail into agreement with the target pressure under feedback control.

When the accelerator pedal is depressed to accelerate the vehicle, after which it is released to decelerate the vehicle, the common rail fuel injection system works to decrease the target pressure of fuel in the common rail rapidly. This may cause the measured value of the pressure in the common rail to be much greater than the target pressure.

In order to decrease the pressure in the common rail quickly to the target pressure, Japanese Patent First Publication No. 2004-011448 teaches use of a pressure-reducing valve in the common rail fuel injection systems which works to drain the fuel from the common rail to the fuel tank.

However, typical pressure-reducing valves may be locked in the closed state or fail to drain the fuel from the common rail correctly due to a malfunction of a valve driver. In order to ensure the reliability of operation of the common rail fuel injection systems, it is desirable to diagnose the pressure-reducing valve.

SUMMARY OF THE INVENTION

It is therefore an object of the invention to provide a fuel injection system which is equipped with a pressure-reducing valve for fuel injection control and designed to ensure enhanced reliability of diagnosis of the pressure-reducing valve.

According to one aspect of the invention, there is provided a fuel injection system which may be employed for automotive common rail diesel engines. The fuel injection system comprises: (a) an accumulator storing therein fuel under a given pressure which is to be injected into an engine; (b) a fuel pump working to pressurize and supply the fuel to the accumulator; (c) a fuel injector working to inject the fuel in the accumulator into the engine; (d) a fuel pressure sensor working to measure a pressure of the fuel in the accumulator to output a signal indicative thereof; (e) a pressure-reducing valve working to drain the fuel from the accumulator to a fuel tank to decrease the pressure of the fuel in the accumulator; and (f) a controller working to monitor the signal outputted from the fuel pressure sensor to control the pressure in the accumulator. The controller includes a first diagnostic circuit and a second diagnostic circuit. The first diagnostic circuit works to diagnose the fuel pressure sensor. The second diagnostic circuit works to monitor a behavior of the pressure in the accumulator, as measured by the fuel pressure sensor when activating the pressure-reducing valve to diagnose the pressure-reducing valve. When a first condition in which the monitored behavior of the pressure in the accumulator is different from a behavior of the pressure in the accumulator, as expected when the pressure-reducing valve is operating properly, and a second condition in which the first diagnostic circuit has diagnosed that the fuel pressure sensor is operating properly are both met, the second diagnostic circuit determines that the pressure-reducing valve is failing in operation thereof.

Usually, when the pressure-reducing valve is failing in operation thereof, it will cause the behavior of the pressure in the accumulator when the controller has tried to open the pressure-reducing valve to be different from that expected to occur when the pressure-reducing valve is operating properly. The fact of such an event is insufficient to make a decision that the pressure-reducing vale is failing. This is because if the fuel pressure sensor has failed to measure the pressure in the accumulator, but the pressure-reducing valve is operating normally, it will cause the second diagnostic circuit to view the behavior of the pressure in the accumulator as being different from that when the pressure-reducing valve is operating properly. In order to avoid this problem, the second diagnostic circuit works to diagnose the pressure-reducing valve only when the first and second conditions are both met.

In the preferred mode of the invention, the second diagnostic circuit works to open the pressure-reducing valve upon turning off of an ignition switch of a vehicle in which the engine is mounted and diagnose whether the pressure-reducing valve is operating properly or not based on the behavior of the pressure in the accumulator arising from opening of the pressure-reducing valve and a result of diagnosis of the fuel pressure sensor made by the first diagnostic circuit. Usually, the pressure of the fuel in the accumulator is insensitive to any factors other than the operation of the pressure-reducing valve after the ignition switch is turned off. The use of the behavior of the pressure in the accumulator after the ignition switch is turned off, thus, results in increased accuracy of diagnosing the pressure-reducing valve.

The first diagnostic circuit works to compare a value of the pressure in the accumulator, as measured by the fuel pressure sensor after elapse of a given period of time following the turning off of the ignition switch, with an atmospheric pressure to diagnose whether the fuel pressure sensor is operating properly or not. The second diagnostic circuit also works to make a temporal diagnosis of the pressure-reducing valve based on the behavior of the pressure in the accumulator arising from the opening of the pressure-reducing valve. When a condition in which the temporal diagnosis that the fuel pressure sensor is operating properly is made and the second condition are both met, the second diagnostic circuit determines that the pressure-reducing valve is failing in operation thereof.

Usually, after the ignition switch is turned off, the pressure in the accumulator drops down to the pressure of atmosphere. The increase in accuracy of diagnosing the fuel pressure sensor is, therefore, achieved by setting the period of time to the time required by the pressure in the accumulator to reach the atmospheric pressure. Further, the pressure of the fuel in the accumulator is insensitive to any factors other than the operation of the pressure-reducing valve after the ignition switch is turned off, thus resulting in increased accuracy of diagnosing the fuel pressure sensor.

The controller may be designed to sample the temperature of coolant of the engine. The first diagnostic circuit may also work to extend the given period of time as the temperature of the coolant decreases. Usually, the lower the temperature of the fuel, the higher will be the viscosity of the fuel, thus resulting in a decreased rate at which the fuel is drained out of the accumulator. This will cause the time required by the pressure in the accumulator to drop down to the atmospheric pressure to change. In order to compensate for this, it is advisable that the given period of time after which the first diagnostic circuit diagnoses the fuel pressure sensor be extended as a function of the temperature of the coolant which has a correlation with the degree of viscosity of the fuel.

The controller may also be designed to sample the temperature of the fuel. The first diagnostic circuit may also work to extend the given period of time as the temperature of the fuel decreases in the same reasons as described above.

The second diagnostic circuit works to use a given criterion for making the temporal diagnosis that the pressure-reducing valve is failing in operation thereof and vary the given criterion as a function of the pressure in the accumulator. Usually, the higher the pressure in the accumulator, the greater will be the rate of a drop in the pressure in the accumulator upon opening of the pressure-reducing valve. In order to compensate for this, it is advisable that the criterion be changed as a function of the pressure in the accumulator.

The second diagnostic circuit may work to use a given criterion for making the temporal diagnosis that the pressure-reducing valve is failing in operation thereof and vary the given criterion as a function of the temperature of the coolant. Usually, the lower the temperature of the fuel, the higher will be the viscosity of the fuel, thus resulting in a decreased rate at which the fuel is drained out of the accumulator which leads to an error in diagnosing the fuel pressure sensor. In order to compensate for this, it is advisable that the given criterion be changed as a function of the temperature of the coolant which has a correlation with the degree of viscosity of the fuel.

The second diagnostic circuit may also work to vary the given criterion as a function of the temperature of the fuel in the same reasons as described above.

After the turning off of the ignition switch, the second diagnostic circuit may works to make the temporal diagnosis of the pressure-reducing valve before the elapse of the given period of time after which the value of the pressure in the accumulator, as measured by the fuel pressure sensor, is sampled by the first diagnostic circuit for diagnosing the fuel pressure sensor. When the condition in which the temporal diagnosis that the fuel pressure sensor is operating properly is made and the second condition are both met, the second diagnostic circuit determines that the pressure-reducing valve is failing in operation thereof after the first diagnostic circuit diagnoses whether the fuel pressure sensor is operating properly or not.

When the second diagnostic has made the temporal diagnosis that the pressure-reducing valve is failing in operation thereof, the first diagnostic circuit works to extend the given period of time to be longer than that when the second diagnostic has made the temporal diagnosis that the pressure-reducing valve is operating properly. Specifically, when the controller has tried to open the pressure-reducing valve, but the pressure in the accumulator, as measured by the fuel pressure sensor, has a value higher than that expected when the pressure-reducing valve is operating normally, there may be the possibility that the pressure-reducing valve is lacking in being opened. In such an event, the rate at which the pressure in the common rail drops will be lowered, thus resulting in an error in diagnosing the fuel pressure sensor. In order to compensate for this, it is advisable that the given period of time be extended to be longer than that when the second diagnostic has made the temporal diagnosis that the pressure-reducing valve is operating properly.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 2(*b*) is an operation chart which shows an operation of the pressure-reducing valve supplied with the power, as illustrated in FIG. 2(*a*);

FIG. 9(*b*) is a graph which shows a change in pressure in a common rail acting on the pressure-reducing valve which is controlled by the amount of power supplied to the pressure-reducing valve, as illustrated in FIG. 9(*a*);

DESCRIPTION OF THE PREFERRED EMBODIMENTS

Figure 1:
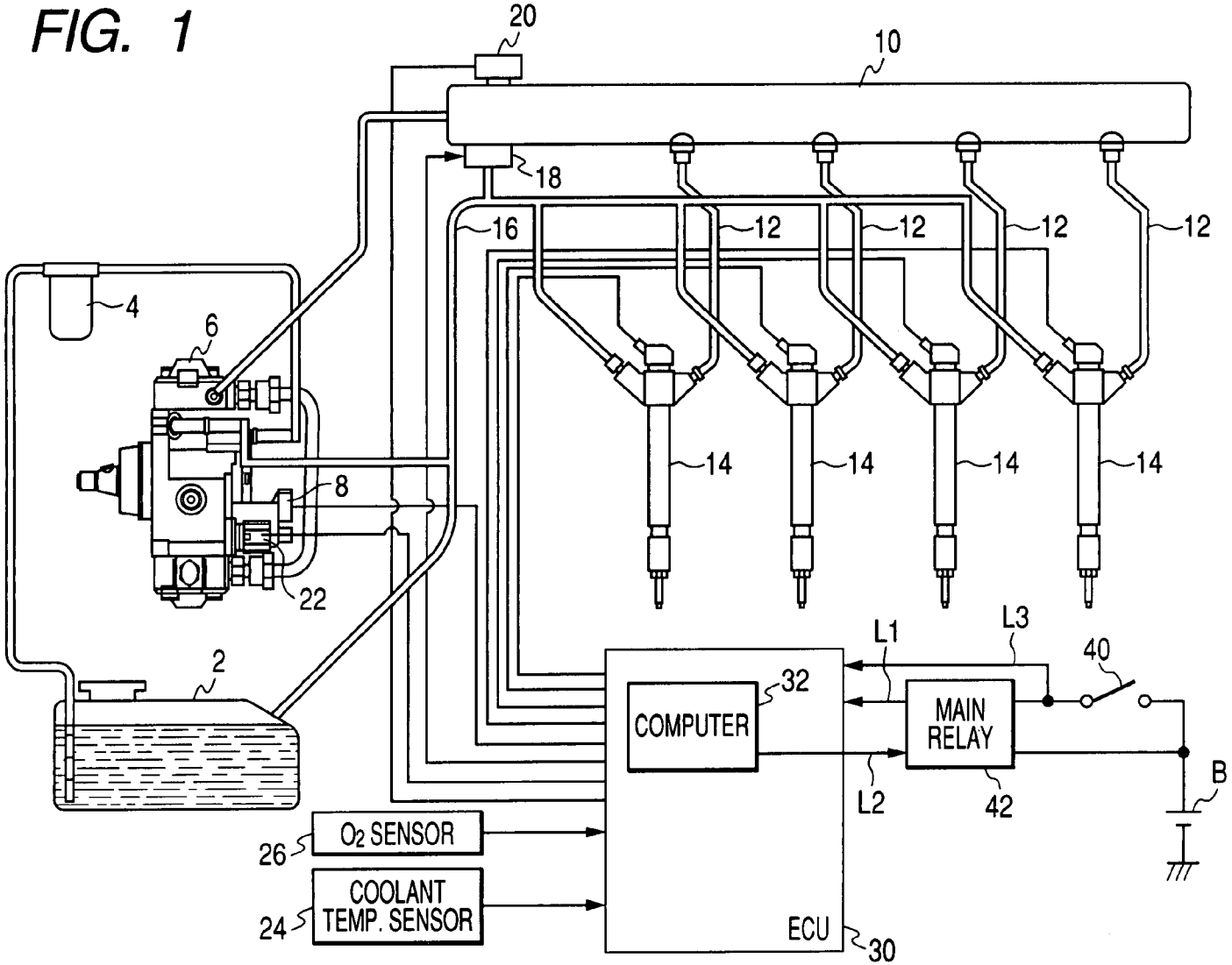
FIG. 1 is a schematic view which shows a fuel injection system according to the first embodiment of the invention.

Referring to the drawings, wherein like reference numbers refer to like parts in several views, particularly to FIG. 1, there is shown a fuel injection system according to the first embodiment of the invention which is designed as a common rail fuel injection system (also called an accumulator injection system) working to control injection of fuel into diesel engines for automotive vehicles.

The fuel injection system includes a fuel pump 6, a common rail 10, fuel injectors 14, a pressure-reducing valve 18, and an electronic control unit (ECU) 30.

The fuel pump 6 works to pump the fuel out of a fuel tank 2 through a fuel filter 4 and feed it to the common rail 10. The fuel pump 6 is driven by torque of a crankshaft (i.e., an output shaft) of the diesel engine. Specifically, the fuel pump 6 is equipped with a suction control valve 8 which is activated by the ECU 30 to determine the amount of fuel to be discharged from the fuel pump 6. The fuel pump 6 is also equipped with a plurality of plungers (or pistons) which are reciprocated between the top and bottom dead centers to suck and discharge the fuel to the common rail 10.

The fuel discharged from the fuel pump 6 is accumulated in the common rail 10 under a given high pressure and then fed to the fuel injectors 14 through high-pressure fuel lines 12. The engine, as referred to here, is a four-cylinder diesel engine as an example. Each of the fuel injectors 14 is provided for one of four cylinders of the engine. The fuel injectors 14 are connected to the fuel tank 2 through a low-pressure fuel line 16. The pressure-reducing valve 18 is installed in the common rail 10 to drain the fuel therefrom to the fuel tank 2 through the low-pressure fuel line 16 to reduce the pressure in the common rail 10.

The fuel injection system also includes a fuel pressure sensor 20, a fuel temperature sensor 22, a coolant temperature sensor 24, and an oxygen sensor (also called $O_2$ sensor) 26. The fuel pressure sensor 20 works to measure the pressure of the fuel in the common rail 10 and output a signal indicative thereof to the ECU 30. The fuel temperature sensor 22 works to measure the temperature of the fuel in the fuel pump 6 and output a signal indicative thereof to the ECU 30. The coolant temperature sensor 24 works to measure the temperature of coolant of the engine and output a signal indicative thereof to the ECU 30. The oxygen sensor 26 works to measure the concentration of oxygen ($O_2$) contained in exhaust emissions of the engine and output a signal indicative thereof to the ECU 30.

The ECU 30 is equipped with a microcomputer 32 and works to monitor outputs of the sensors 20, 22, 24, and 26 to control an output of the diesel engine. The ECU 30 is supplied with electric power from a storage battery B through an ignition switch 40, a main relay 42, and a power supply line L1.

The main relay 42 works to establish a connection between the battery B and the power supply line L1 when the ignition switch 40 is turned on or a drive signal is inputted thereinto through a signal line L2. Specifically, when the ignition switch 40 is turned on, the main relay 42 connects between the battery B and the power supply line L1 to activate the ECU 30.

When being supplied with the electric power from the battery B, the ECU 30 monitors an on/off state of the ignition switch 40 through the signal line L3. When the ignition switch 40 is turned off, the ECU 30 outputs the drive signal to the main relay 42 through the signal line L2 to keep the supply of the power thereto until completion of a given post-task in the ECU 30.

Figures 2A, 2B:
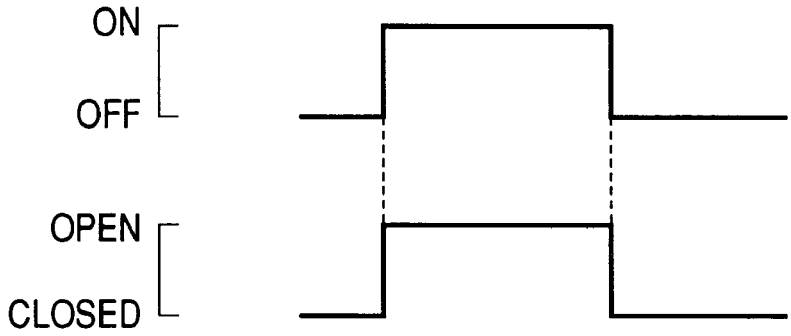
FIG. 2(*a*) is an operation chart which shows a supply of electric power to a pressure-reducing valve.

When the ignition switch 40 is turned on, the ECU 30 starts to perform a fuel injection operation to control the output of the diesel engine. Specifically, the ECU 30 works to control the operation of the suction control valve 8 of the fuel pump 6 to bring the pressure of fuel in the common rail 10 into agreement with a target one, as selected as functions of the operating condition and environmental condition of the engine under feedback control. However, when it is required to decrease target pressure rapidly, it may result in a difficulty in bringing an actual pressure of fuel in the common rail 10 into agreement with the target pressure. In order to avoid this problem, the ECU 30 turns on, as demonstrated in FIG. 2(*a*), the pressure-reducing valve 18 to open it, as demonstrated in FIG. 2(*b*), to drain the fuel out of the common rail 10 to minimize a difference between the actual pressure and the target pressure in the common rail 10.

The ECU 30 is also designed to diagnose the status of the pressure-reducing valve 18, that is, to monitor a malfunction thereof such as a failure in opening the pressure-reducing valve 18 although the ECU 30 energizes it. This diagnosis may be made by energizing the pressure-reducing valve 18 and sampling an output of the fuel pressure sensor 20 which must indicate a drop in pressure of the fuel in the common rail 10 if the fuel pressure sensor 20 is operating properly. However, if the fuel pressure sensor 20 is malfunctioning, it will result in a difficulty in determining the pressure in the common rail 10 correctly. It is, therefore, difficult to use the output of the fuel pressure sensor 20 to ensure the reliability of the diagnosis of the pressure-reducing valve 18.

Figure 3A:
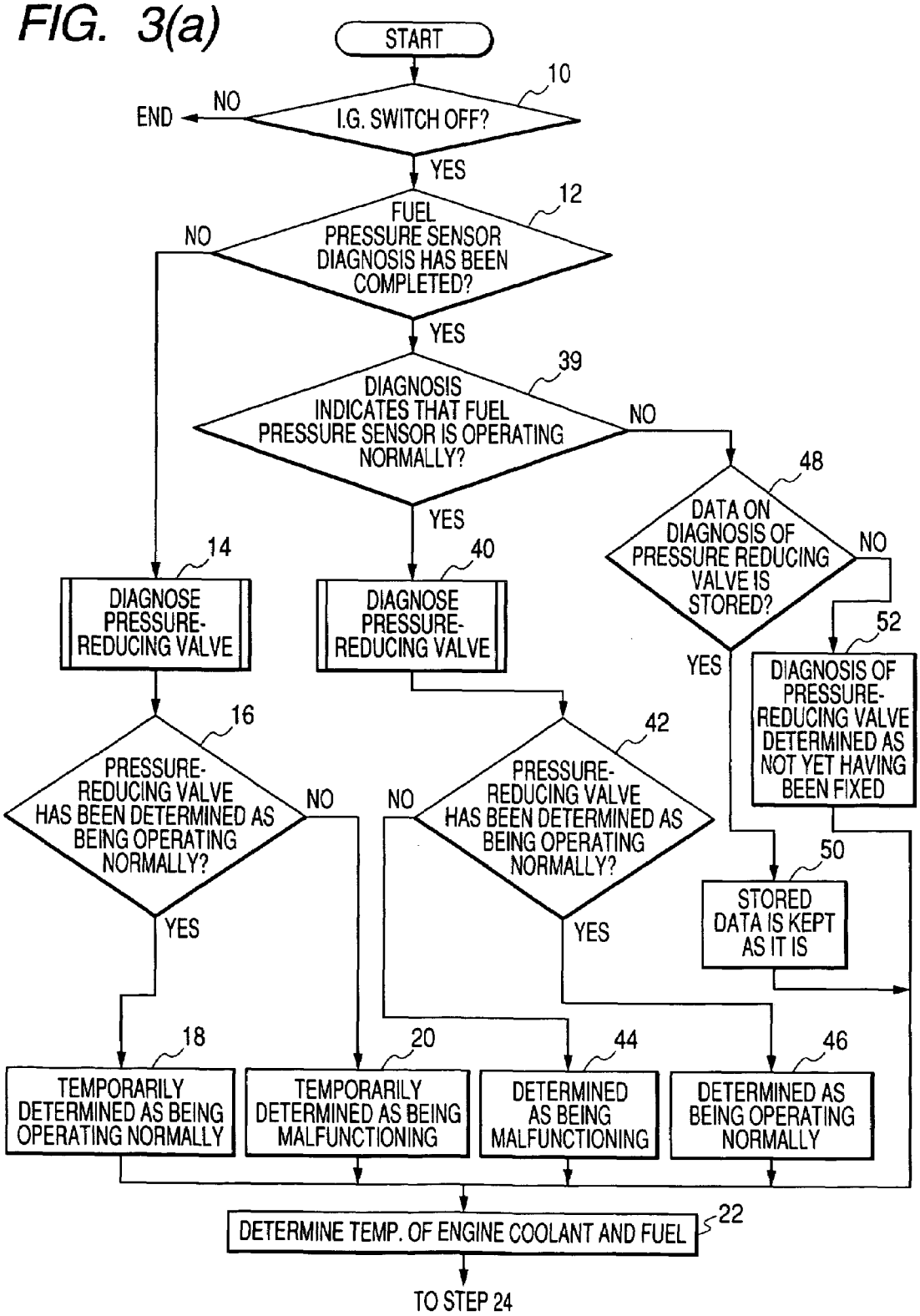
FIGS. 3(*a*) and 3(*b*) are a flowchart which shows a diagnostic program to diagnose a pressure-reducing valve in the fuel injection system of FIG. 1.
Figure 3B:
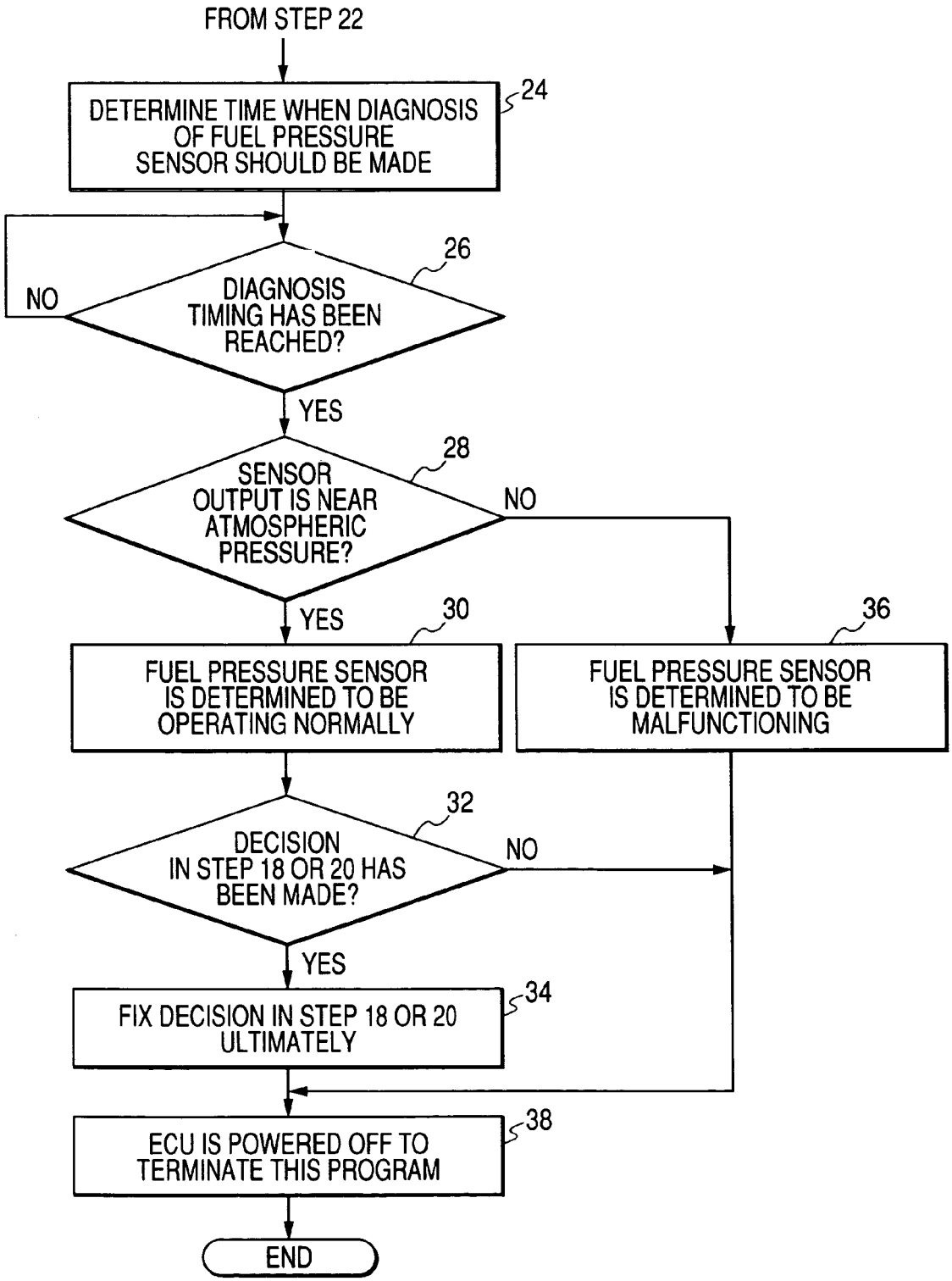

In order to eliminate the above drawback, the ECU 30 is designed to monitor the behavior of the pressure of fuel in the common rail 10 arising from opening the pressure-reducing valve 18 and the diagnosis of whether the pressure-reducing valve 18 is malfunctioning or not to determine whether the pressure-reducing valve 18 is malfunctioning or not. FIGS. 3(*a*) and 3(*b*) show a flowchart of a diagnostic program to be executed by the ECU 30 at given intervals to diagnose the status of the pressure-reducing valve 18.

After entering the program, the routine proceeds to step 10 wherein the ignition switch 40 is in the off-state or not. If a YES answer is obtained meaning that the ignition switch 40 is in the off-state, then the routine proceeds to step 12 wherein it is determined whether the diagnosis of whether the fuel pressure sensor 20 is malfunctioning or not has been completed or not. If the current program execution cycle is the first cycle, it is determined that the fuel pressure sensor diagnosis has not yet been completed. The routine proceeds to step 14 wherein the status of the pressure-reducing valve 18 is diagnosed.

Figure 4:
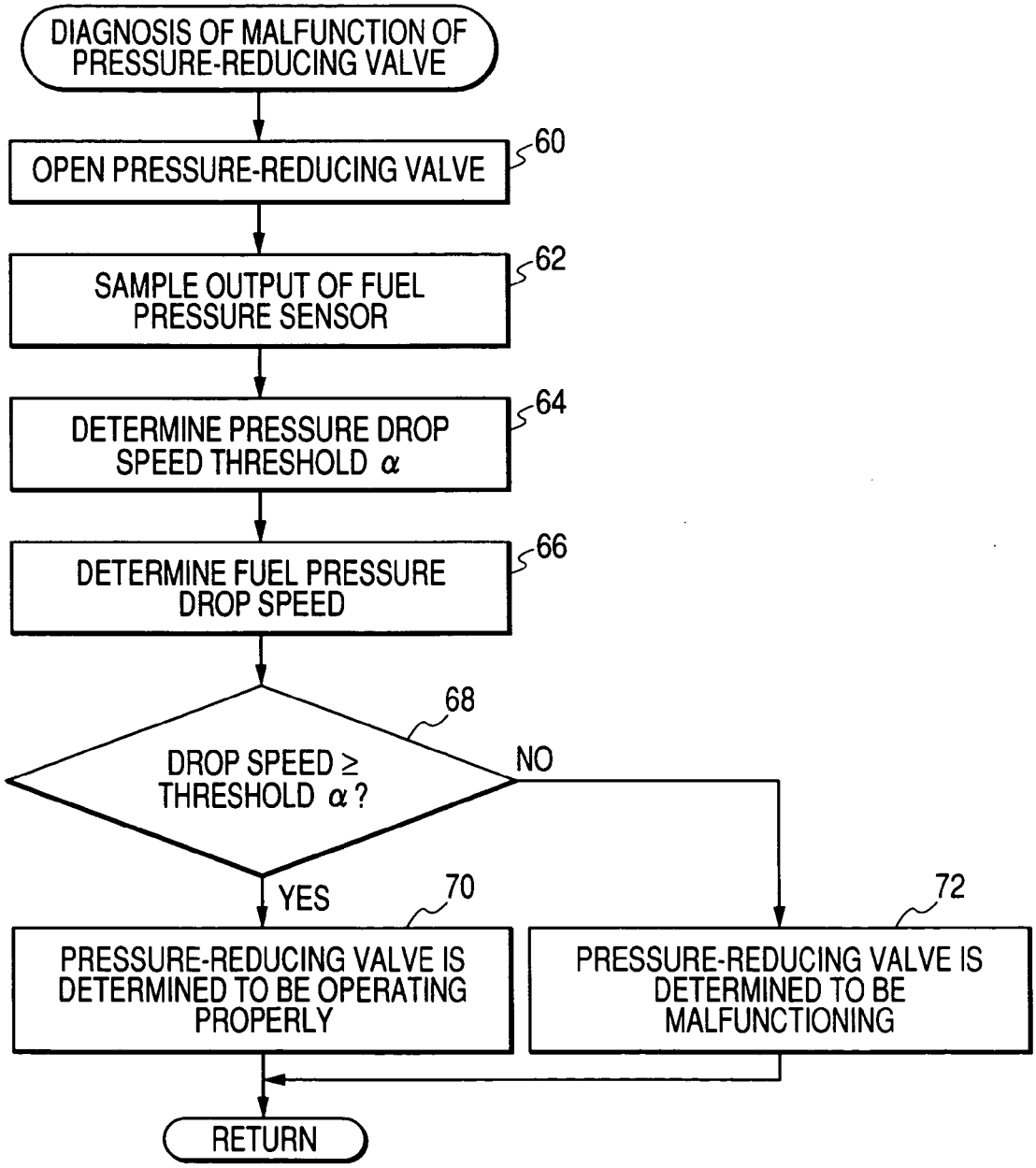
FIG. 4 is a flowchart of a sub-program which makes a temporal diagnosis of a pressure-reducing valve in the main program of FIGS. 3(*a*) and 3(*b*)

After entering step 14, the routine proceeds to step 60, as illustrated in FIG. 4, wherein the ECU 30 energizes the pressure-reducing valve 18 to open it.

The routine proceeds to step 62 wherein an output of the fuel pressure sensor 20 is sampled upon the opening of the pressure-reducing valve 18. This step may alternatively be performed before step 60 to sample the output of the fuel pressure sensor 20 immediately before the pressure-reducing valve 18 is opened. The routine proceeds to step 64 wherein a threshold $\alpha$ of a drop rate of the pressure of fuel in the common rail 10 which is expected to arise from the opening of the pressure-reducing valve 18 when operating properly is calculated. Specifically, the threshold $\alpha$ is determined by subtracting a given margin $\epsilon$ from the sum of the rate at which the pressure in the common rail 10 is decreased by draining the fuel through the pressure-reducing valve 18 and the rate at which the pressure in the common rail 10 is decreased due to a static leakage of the fuel from the common rail 10 through the fuel injectors 14. The rate of the drop in fuel pressure in the common rail 10 caused by the opening of the pressure-reducing valve 18 is so determined that it increases with an increase in the fuel pressure in the common rail 10. The rate of the drop in fuel pressure in the common rail 10 caused by the static leakage of the fuel is the rate at which the fuel escapes from the high-pressure fuel lines 12 to the low-pressure fuel line 16 through clearances in the fuel injectors 14. This drop rate is determined using the output of the fuel pressure sensor 20 upon the opening of the pressure-reducing valve 18 based on the fact that the higher the pressure in the common rail 10, the more will be the amount of the static leakage of the fuel.

The routine proceeds to step 66 wherein time-sequential data on outputs of the fuel pressure sensor 20 is analyzed to calculate the rate at which the pressure of the fuel in the common rail 10 has dropped. Specifically, using at least two outputs of the fuel pressure sensor 20, as sampled at a given interval, the rate at which the pressure in the common rail 10 has drops is calculated as the drop rate.

The routine proceeds to step 68 wherein it is determined whether the drop rate, as calculated in step 66, is greater than or equal to the threshold $\alpha$ or not. If a YES answer is obtained, then the routine proceeds to step 70 wherein it is determined whether the pressure-reducing valve 18 is operating properly. Alternatively, if a NO answer is obtained, then the routine proceeds to step 72 wherein it is determined that the pressure-reducing valve 18 is malfunctioning.

After step 70 or 72, the routine proceeds to step 16, as illustrated in FIG. 3(*a*), wherein it is determined whether the pressure-reducing valve 18 has been determined in step 14 as being operating properly or not. If a YES answer is obtained meaning that the determination that the pressure-reducing valve 18 is operating normally has been made in step 14, then the routine proceeds to step 18 wherein it is temporarily determined that the pressure-reducing valve 18 is operating properly. Alternatively, if it is determined in step 16 that the pressure-reducing valve 18 has been determined in step 14 as being malfunctioning, the routine proceeds to step 20 wherein it is temporarily determined that the pressure-reducing valve 18 is malfunctioning. The result of the diagnosis in step 18 or 20 is stored in the memory of the microcomputer 32.

After step 18 or 20, the routine proceeds to step 22 wherein outputs of the coolant temperature sensor 24 and the fuel temperature sensor 22 are sampled to determine the temperature of the coolant of the engine and the temperature of the fuel in the fuel pump 6. The routine proceeds to step 24 wherein the time at which the fuel pressure sensor 20 should be diagnosed is determined based on the temperatures of the fuel in the fuel pump 6 and the coolant of the engine and the status of the pressure-reducing valve 18. Specifically, such a time is set after the elapse of time required for the pressure of fuel in the common rail 10 to drop down to the atmospheric pressure following the turning off of the ignition switch 40. This is because after the ignition switch 40 is turned off, the pressure in the common rail 10 usually drops to the atmospheric pressure, thus, it is possible to determine that the fuel pressure sensor 20 is malfunctioning when the pressure in the common rail 10, as sampled by the fuel pressure sensor 20 after the elapse of time required by the pressure in the common rail 10 from the turning off of the ignition switch 40 to drop to the atmospheric pressure, is higher than the atmospheric pressure.

The temperatures of the fuel in the fuel pump 6 and the coolant of the engine are parameters showing a correlation with the temperature of the fuel in the common rail 10. In general, the lower the temperature of the fuel in the common rail 10, the greater will be the viscosity of the fuel, so that the speed or rate at which the fuel is drained from the common rail 10 to the fuel tank 2 will drop. The time required by the pressure of fuel in the common rail 10 to drop down to the atmospheric pressure is, therefore, thought of as being extended as the temperature of the fuel in the fuel pump 6 and the temperature of the coolant of the engine decrease. Consequently, as the temperatures of the fuel in the fuel pump 6 and the coolant of the engine are low, the time at which the fuel pressure sensor 20 should be diagnosed is prolonged.

Additionally, the status of the pressure-reducing valve 18 is a factor which influences a drop in pressure of the fuel in the common rail 10. Specifically, when the pressure-reducing valve 18 is in the off-state (i.e., the closed-state), a drop in pressure in the common rail 10 will arise only from the static leakage of fuel through the fuel injectors 14, thus resulting in a decreased rate of a drop in pressure in the common rail 10. If the pressure-reducing valve 18 has failed to be opened, it will cause a variation in pressure in the common rail 10 will be viewed as being the same as when the pressure-reducing valve 18 is placed in the off-state. Therefore, in step 24, when the pressure-reducing valve 18 is not opened after the ignition switch 40 is turned off or the determination that the pressure-reducing valve 18 is malfunctioning has been made, the time at which the fuel pressure sensor 20 should be diagnosed is set later than that when the pressure-reducing valve 18 is opened, and the determination that the pressure-reducing valve 18 is operating properly has been made.

After step 24, the routine proceeds to step 26 wherein it is determined whether the time when the fuel pressure sensor 20 should be diagnosed has been reached or not. If a YES answer is obtained, then the routine proceeds to step 28 wherein it is determined whether the pressure of fuel in the common rail 10, as measured by the fuel pressure sensor 20, lies within a range defined around the pressure of the atmosphere or not. If a YES answer is obtained, then the routine proceeds to step 30 wherein the fuel pressure sensor 20 is operating normally. The routine proceeds to step 32 wherein it is determined whether the temporal determination that the pressure-reducing valve 18 is operating normally or malfunctioning has been made or not, in other words, the decision in step 18 or 20 has been made or not. If a YES answer is obtained, then the routine proceeds to step 34 wherein the decision in step 18 or 20 is settled ultimately.

Alternatively, if a NO answer is obtained in step 28 meaning that the pressure of fuel in the common rail 10, as measured by the fuel pressure sensor 20, lies out of the range defined around the pressure of the atmosphere, then the routine proceeds to step 36 wherein the fuel pressure sensor 20 is malfunctioning.

After step 34 or 36, then the routine proceeds to step 38 wherein the ECU 30 is powered off to terminate this program.

If a YES answer is obtained in step 12 meaning that it is determined that the diagnosis of whether the fuel pressure sensor 20 is malfunctioning or not has been completed, then the routine proceeds to step 39 wherein it is determined whether the diagnosis of the fuel pressure sensor 20, as already made, indicates that the fuel pressure sensor 20 is operating normally or not, that is, whether the decision, as already made in step 30 or 36 in a previous cycle, represents that the fuel pressure sensor 20 is operating normally or that it is malfunctioning.

If a YES answer is obtained in step 39 meaning that the decision that the fuel pressure sensor 20 is operating normally has been made, then the routine proceeds to step 40 wherein the pressure-reducing valve 18 is diagnosed. This diagnosis is made in the same manner as that in step 14, and explanation thereof in detail will be omitted here.

Subsequently, the routine proceeds to step 42 wherein it is determined whether the pressure-reducing valve 18 has been determined in step 40 as being operating properly or not. If a YES answer is obtained meaning that the determination that the pressure-reducing valve 18 is operating normally has been made in step 40, then the routine proceeds to step 46 wherein it is determined that the pressure-reducing valve 18 is operating properly. Alternatively, if it is determined in step 42 that the pressure-reducing valve 18 has been determined in step 40 as being malfunctioning, the routine proceeds to step 44 wherein it is determined that the pressure-reducing valve 18 is malfunctioning.

If a NO answer is obtained in step 39 meaning that the fuel pressure sensor 20 is determined as being malfunctioning, then the routine proceeds to step 48 wherein it is determined whether data on the diagnosis of the pressure-reducing valve 18 has been stored in the memory of the microcomputer 32 or not. If a YES answer is obtained, then the routine proceeds to step 50 wherein the data stored in the memory is kept as it is. Alternatively, if a NO answer is obtained, then the routine proceeds to step 52 wherein it is determined that the diagnosis of the pressure-reducing valve 18 has not yet been completed or fixed.

After step 44, 46, 50, or 52, the routine proceeds to step 22, as described above.

If a NO answer is obtained in step 10 meaning that the ignition switch 40 is not in the off-state, the routine terminates.

Figures 5A, 5B, 5C, 5D, 5E:
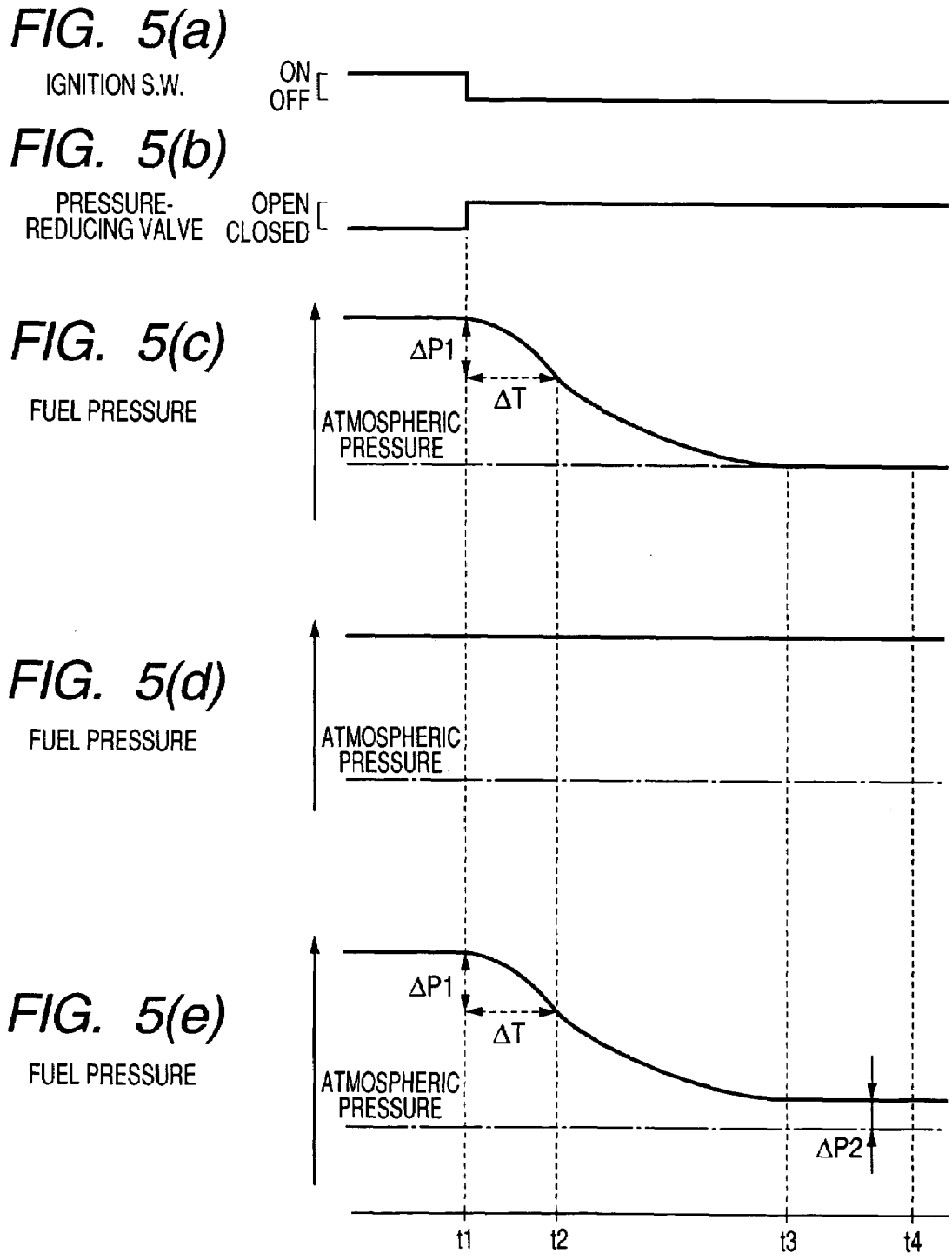
FIGS. 5(*a*), 5(*b*), 5(*c*), 5(*d*), and 5(*e*) are timing charts for demonstrating an operation of a pressure-reducing valve to be diagnosed by the fuel injection system of FIG. 1.

An example of operation of the fuel injection system of this embodiment will be described below with reference to FIGS. 5(*a*) to 5(*e*). FIGS. 5(*a*) to 5(*e*) demonstrate the status of the ignition switch 40, the status of the pressure-reducing valve 18, and values of pressure of fuel in the common rail 10, as measured by the fuel pressure sensor 20.

When the fuel pressure sensor 20 is operating properly, the ignition switch 40 is turned on, and the pressure-reducing valve 18 is opened at time t1, an output of the fuel pressure sensor 20 indicates that the pressure in the common rail 10 drops, as illustrated in FIG. 5(*c*). In the illustrated example, the rate of a drop in pressure in the common rail 10 between times t1 and t2 (i.e., $\Delta P1/\Delta T$) is determined in step 68 of FIG. 4 as being greater than or equal to the threshold $\alpha$. It is, thus, determined in step 24 of FIG. 3(*b*) that the pressure-reducing valve 18 is operating properly. When time t3 is reached a period of time, as determined in step 24, after time t1, the pressure in the common rail 10, as measured by the fuel pressure sensor 20, has dropped down to the atmospheric pressure. It is, thus, determined in step 30 of FIG. 3(*b*) that the fuel pressure sensor 20 is operating properly. This causes the temporal decision about the diagnosis of the pressure-reducing valve 18 to be ultimately fixed in step 34 of FIG. 3(*b*).

For instance, as illustrated in FIG. 5(*d*), if the fuel pressure sensor 20 is locked and has failed to produce a correct output, it will cause the pressure in the common rail 10, as indicated by the fuel pressure sensor 20, to be kept as it even after the ignition switch 40 is turned off. It is, thus, temporarily determined in step 18 of FIG. 3(*a*) that the pressure-reducing valve 18 is malfunctioning. This causes the diagnosis of the fuel pressure sensor 20 to be made after the elapse of time, as determined to be required by the pressure in the common rail 10 to drops down to the atmospheric pressure under the assumption that the pressure-reducing valve 18 is placed in the closed state. At time t4 after the elapse of such a required time, the pressure in the common rail 10 does not yet reach the atmospheric pressure. This causes the fuel pressure sensor 20 to be determined in step 36 of FIG. 3(*b*) as being malfunctioning, so that the temporal decision about the diagnosis of the pressure-reducing valve 18 is not fixed. This eliminates an error in diagnosing the pressure-reducing valve 18 arising from the malfunctioning of the fuel pressure sensor 20.

FIG. 5(*e*) illustrates for the case where an offset error of an output of the fuel pressure sensor 20 that is the sum of an actual value of the pressure in the common rail 10 and an offset has occurred.

The rate of a drop in pressure in the common rail 10 between times t1 and t2 is identical with that, as illustrated in FIG. 5(*c*). The pressure of the fuel in the common rail 10, as indicated by the fuel pressure sensor 20 immediately before the pressure-reducing valve 18 is opened, however, shows the level higher than that in FIG. 5(*c*). This causes the threshold $\alpha$, as determined in step 64 of FIG. 4, to be greater than that in FIG. 5(*c*), which may result in an error in determining temporarily in step 14 of FIG. 3(*a*), that the pressure-reducing valve 18 is malfunctioning. However, the pressure in the common rail, as measured at time t4, after the elapse of the time, as determined in step 24, does not lie near the atmospheric pressure, so that it is determined in step 36 of FIG. 3(*b*) that the fuel pressure sensor 20 is malfunctioning. The temporal decision of the diagnosis of the pressure-reducing valve 18 is, therefore, not fixed ultimately. This eliminates an error in diagnosing the pressure-reducing valve 18 arising from the malfunctioning of the fuel pressure sensor 20.

In the above discussion, it is assumed that the negative decision is made in step 12 of FIG. 3(*a*). In the examples of FIGS. 5(*d*) and 5(*e*), after once the fuel pressure sensor 20 is determined as being malfunctioning, the positive decision is made in step 12, so that the diagnosis of the pressure-reducing valve 18 is not made.

It is advisable that it be determined which of the locking of the fuel pressure sensor 20, as illustrated in FIG. 5(*d*), and the offset error of the output of the fuel pressure sensor 20, as illustrated in FIG. 5(*e*), causes the malfunctioning of the fuel pressure sensor 20. This distinction be made by using both a value of the pressure in the common rail 10, as measured immediately after the ignition switch 40 is turned off, and a value of the pressure in the common rail 10, as used in step 28 of FIG. 3(*b*). When it is determined that the offset error has contributed to the decision that the fuel pressure sensor 20 is malfunctioning, the offset $\Delta P2$, as shown in FIG. 5(*e*), may be found and used in correcting the output of the fuel pressure sensor 20. The use of such a corrected output of the fuel pressure sensor 20 will ensure the accuracy in diagnosing the pressure-reducing valve 18.

As apparent from the above discussion, when the result of a logical AND of the condition that the behavior of the pressure in the common rail 10, as monitored by the fuel pressure sensor 20 when the pressure-reducing valve 18 is opened, is different from that, as expected when the pressure-reducing valve 18 is operating properly, and the condition that it is determined that the fuel pressure sensor 20 is operating properly is true, the ECU 30 decides that the pressure-reducing valve 18 is malfunctioning. This eliminates an error in diagnosing the pressure-reducing valve 18 arising from the malfunctioning of the fuel pressure sensor 20.

The diagnosis of the fuel pressure sensor 20 is performed based on comparison between the pressure of fuel in the common rail 10, as measured after the elapse of a selected time following the turning off of the ignition switch 40, and the atmospheric pressure. The degree of a factor influencing the behavior of the pressure in the common rail 10 after the ignition switch 40 is turned off is smaller than that when the ignition switch 40 is in the on-state, thereby resulting in increased accuracy of the diagnosis of the fuel pressure sensor 20.

The diagnosis of the pressure-reducing valve 18 is made after the ignition switch 40 is turned off. The degree of a factor influencing the behavior of the pressure in the common rail 10 after the ignition switch 40 is turned off is, as described above, smaller than that when the ignition switch 40 is in the on-state, thereby resulting in increased accuracy of the diagnosis of the pressure-reducing valve 18.

As the temperature of the coolant of the engine or the temperature of the fuel in the fuel pump 6 decreases, a period of time which is to be consumed until the fuel pressure sensor 20 starts to be diagnosed is extended, thereby ensuring that the diagnosis of the fuel pressure sensor 20 is made after the pressure in the common rail 10 may be viewed as having dropped down to the atmospheric pressure.

The criterion (i.e., the threshold $\alpha$) for diagnosing the pressure-reducing valve 18 is changed as a function of the pressure of fuel in the common rail 10, so that the criterion may be prepared correctly when the rate at which the pressure is decreased by the pressure-reducing valve 18 has changed with a change in pressure in the common rail 10.

After the ignition switch 40 is turned off, the pressure-reducing valve 18 is first diagnosed temporarily. Subsequently, the fuel pressure sensor 20 is diagnosed. When it is diagnosed that the fuel pressure sensor 20 is operating properly, the temporal diagnosis of the pressure-reducing valve 18 is fixed as a final diagnosis. This results in increased accuracy in diagnosing the pressure-reducing valve 18.

When it is diagnosed that the pressure-reducing valve 18 is malfunctioning, a period of time which is to be consumed until the diagnosis of the fuel pressure sensor 20 is extended, thereby ensuring that the diagnosis of the fuel pressure sensor 20 is made after the pressure in the common rail 10 may be viewed as having dropped down to the atmospheric pressure.

The fuel injection system of the second embodiment will be described below which is designed to determine the threshold $\alpha$ for use in diagnosing the pressure-reducing valve 18 as functions of temperatures of the fuel in the fuel pump 6 and the coolant of the engine as well as the pressure of fuel in the common rail 10.

Figure 6:
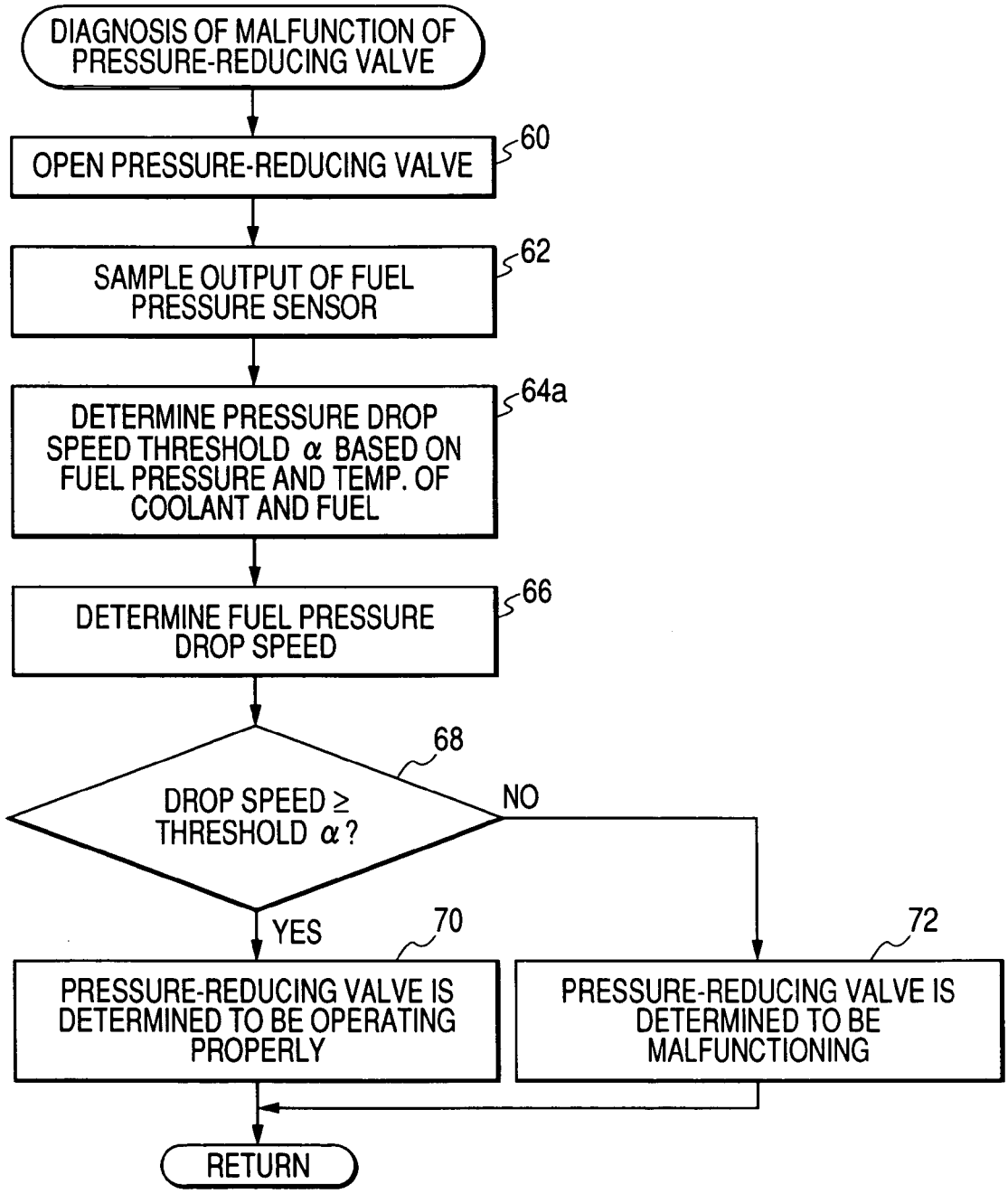
FIG. 6 is a flowchart of a sub-program which makes a temporal diagnosis of a pressure-reducing valve in the second embodiment of the invention.

FIG. 6 shows a diagnosis program to be executed by the ECU 30 of the fuel injection system of this embodiment to diagnose the pressure-reducing valve 18. This program is performed in step 14 of FIG. 3(*a*). The same reference numbers as employed in FIG. 4 will refer to the same operations, and explanation thereof in detail will be omitted here.

After the output of the fuel pressure sensor 20 is sampled when the pressure-reducing valve 18 is opened in step 62, the routine proceeds to step 64*a* wherein the threshold $\alpha$ is calculated based on the pressure of fuel in the common rail 10, the temperature of the fuel in the fuel pump 6, and the temperature of the coolant of the engine which are measured upon opening of the pressure-reducing valve 18. The temperature of the fuel in the fuel pump 6 and the temperature of the coolant of the engine are parameters each of which shows a correlation with the temperature of the fuel in the common rail 10. In general, the lower the temperature of the fuel in the common rail 10, the greater will be the viscosity of the fuel, so that the rate at which the fuel is drained by the pressure-reducing valve 18 from the common rail 10 to the fuel tank 2 will drop. Consequently, the threshold $\alpha$ is so selected that it decreases with decreases in temperature of the fuel in the fuel pump 6 and/or the temperature of the coolant of the engine.

After the threshold a is determined, the routine proceeds to step 68 to compare the drop rate, as calculated in step 66, with the threshold $\alpha$ for diagnosing the pressure-reducing valve 18.

Figure 7:
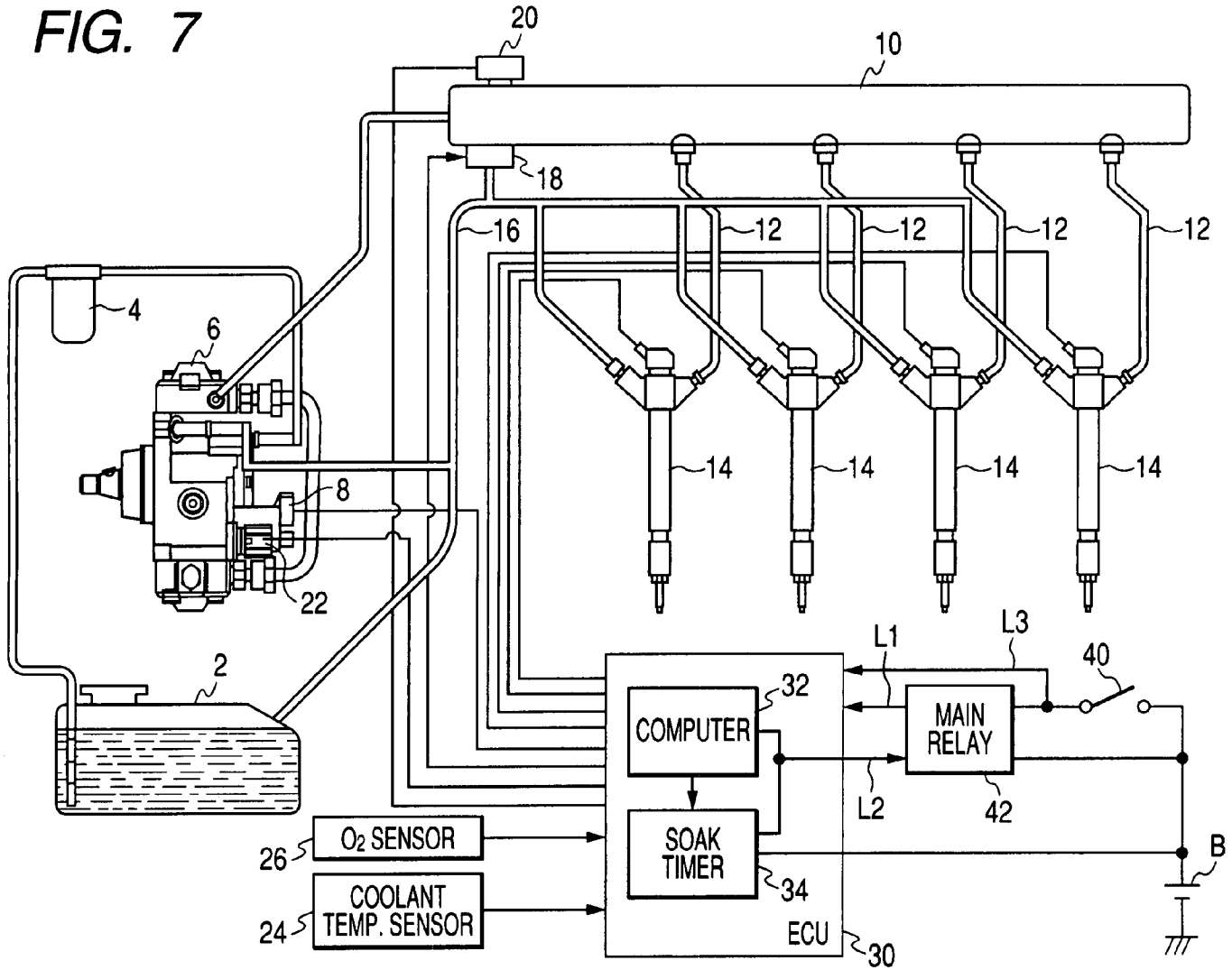
FIG. 7 is a schematic view which shows a fuel injection system according to the third embodiment of the invention.

FIG. 7 shows a fuel injections system according to the third embodiment of the invention which is a modification of the one, as illustrated in FIG. 1. The same reference numbers as employed in FIG. 1 will refer to the same parts, and explanation thereof in detail will be omitted here.

The ECU 30 is equipped with a soak timer 34 which works to turn on the ECU 30 after the elapse of time, as set by the soak timer 32. Specifically, the soak timer 34 is kept activated even after the ignition switch 40 is turned off to cut a supply of electric power to the ECU 30 and works to count the elapsed time from the turning off of the ECU 30. When the elapsed time, as counted by the soak timer 34, reaches the time, as set by the microcomputer 32, the soak timer 34 starts to supply the electric power from the battery B to the ECU 30.

Figure 8A:
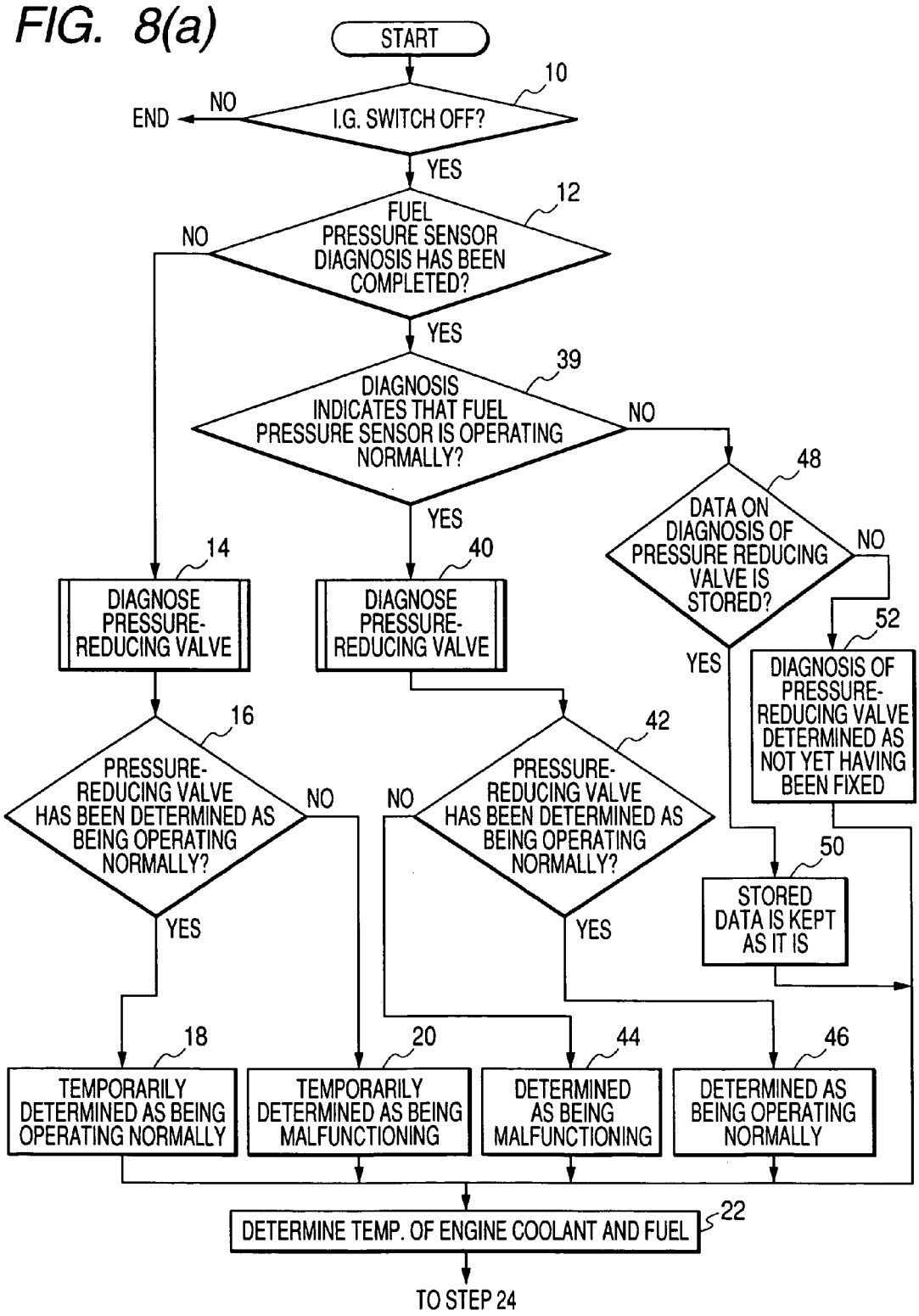
FIGS. 8(*a*) and 8(*b*) are a flowchart of a diagnostic program to be executed by the fuel injection system of FIG. 7 to diagnose a pressure-reducing valve.
Figure 8B:
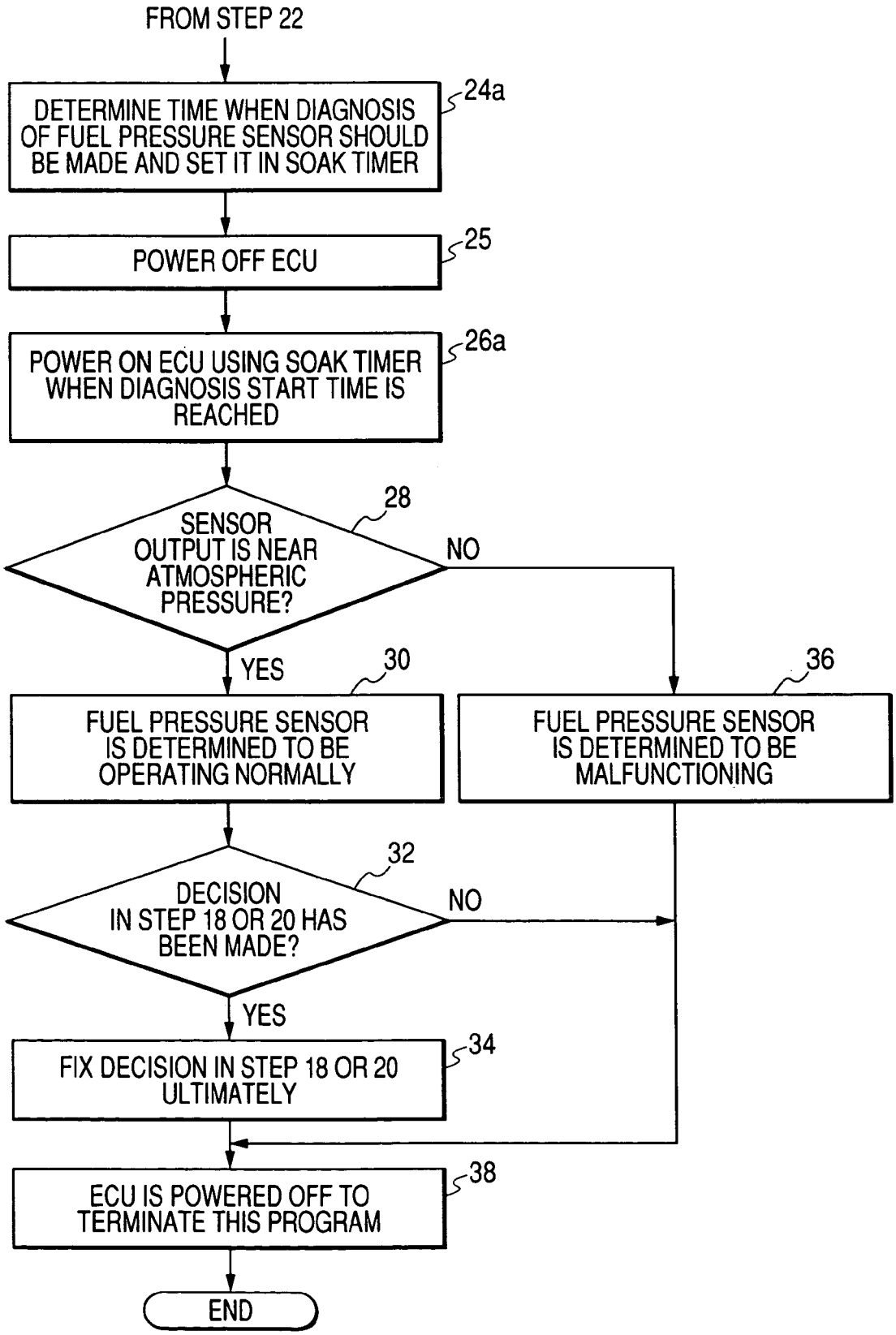

FIGS. 8(*a*) and 8(*b*) show a flowchart of a diagnostic program to be executed by the ECU 30 at given intervals to diagnose the pressure-reducing valve 18 and the fuel pressure sensor 20 using the soak timer 34. The same step numbers as employed in FIGS. 3(*a*) and 3(*b*) will refer to the same operations, and explanation thereof in detail will be omitted here.

After outputs of the coolant temperature sensor 24 and the fuel temperature sensor 22 are sampled to determine the temperature of the coolant of the engine and the temperature of the fuel in the fuel pump 6 in step 22 of FIG. 8(*a*), the routine proceeds to step 24*a*, as illustrated in FIG. 8(*b*), wherein a diagnosis start time that is the time when the fuel pressure sensor 20 should be diagnosed is first determined based on the temperatures of the fuel in the fuel pump 6 and the coolant of the engine and the status of the pressure-reducing valve 18 in the same manner, as described in step 24 of FIG. 3(*b*). Next, the diagnosis start time is set in the soak timer 34.

The routine proceeds to step 25 wherein the ECU 25 is powered off. Specifically, after it is determined in step 10 that the ignition switch 40 has been turned off, the ECU 30 continues to output the drive signal to the main relay 42 through the signal line L2 to keep the supply of power from the battery B to the ECU 30. In step 25, the ECU 30 stops outputting the drive signal to cut the supply of power to itself. The soak timer 34 starts to count the elapsed time from the turning off of the ECU 30. When the elapsed time reaches the diagnosis start time, the routine proceeds to step 26*a* wherein the soak timer 34 works to activate the ECU 30. Specifically, the soak timer 34 outputs the drive signal to the main relay 42 through the signal line L2 to supply the power to the ECU 30 to turn on the microcomputer 32. When being turned on, the microcomputer 32 performs steps 28 to 36 of FIG. 8(*b*).

As apparent from the above discussion, the ECU 30 is kept off after the diagnosis start time is set and turned on by the soak timer 34 when the diagnosis start time is reached to diagnose the fuel pressure sensor 20. Use of the soak timer 34, thus, results in power saving of the battery B.

The fuel injection system of the fourth embodiment will be described below which is equipped with the pressure-reducing valve 18 of a normally open type. Other arrangements are identical with those in the first embodiment, and explanation thereof in detail will be omitted here.

Figure 9A:
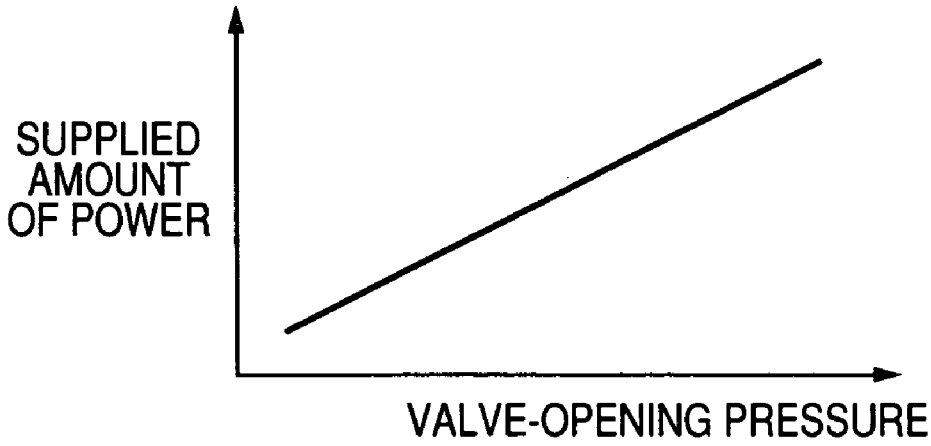
FIG. 9(*a*) is a graph which shows a relation between the amount of power supplied to a pressure-reducing valve, as used in the fourth embodiment of the invention, and the pressure serving to open the pressure-reducing valve.
Figure 9B:
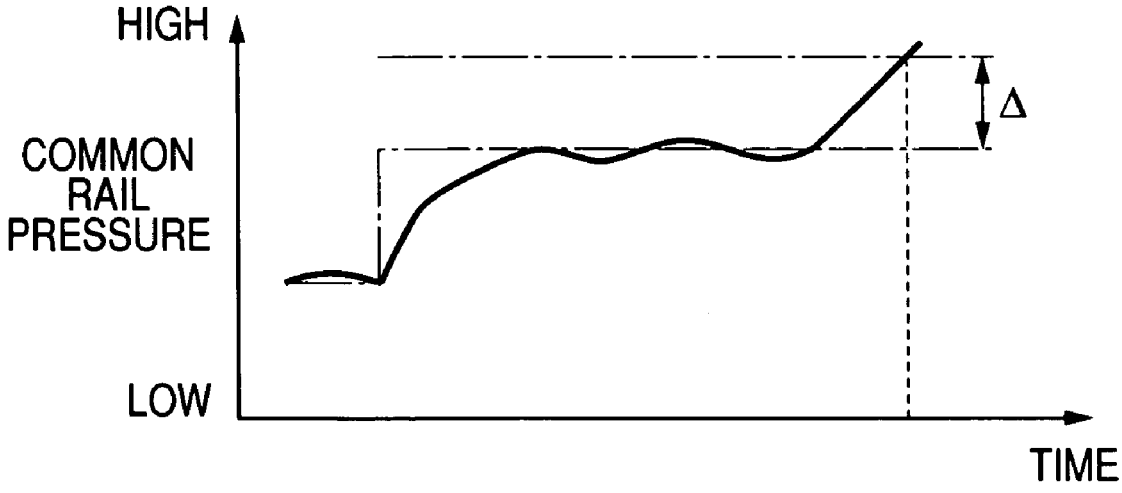

The pressure-reducing valve 18 is kept opened when being in the off-state. The pressure-reducing valve 18 is, as illustrated in FIG. 9(*a*), so designed that an increase in amount of electric power supplied to the pressure-reducing valve 18 will cause the level of pressure in the common rail 10 acting on the pressure-reducing valve 18 to open it to increase. The ECU 30 works to control the amount of electric power supplied to the pressure-reducing valve 18 so that the pressure-reducing valve 18 is opened when the pressure of fuel, as denoted by a solid line in FIG. 9(*b*), acting thereon is elevated up to a level, as denoted by a chain double-dashed line, higher than a target level, as denoted by a chain line in FIG. 9(*b*), by a given value Δ.

The ECU 30 is designed to diagnose the fuel pressure sensor 20 using an output of the diesel engine in the following manner.

Figure 10:
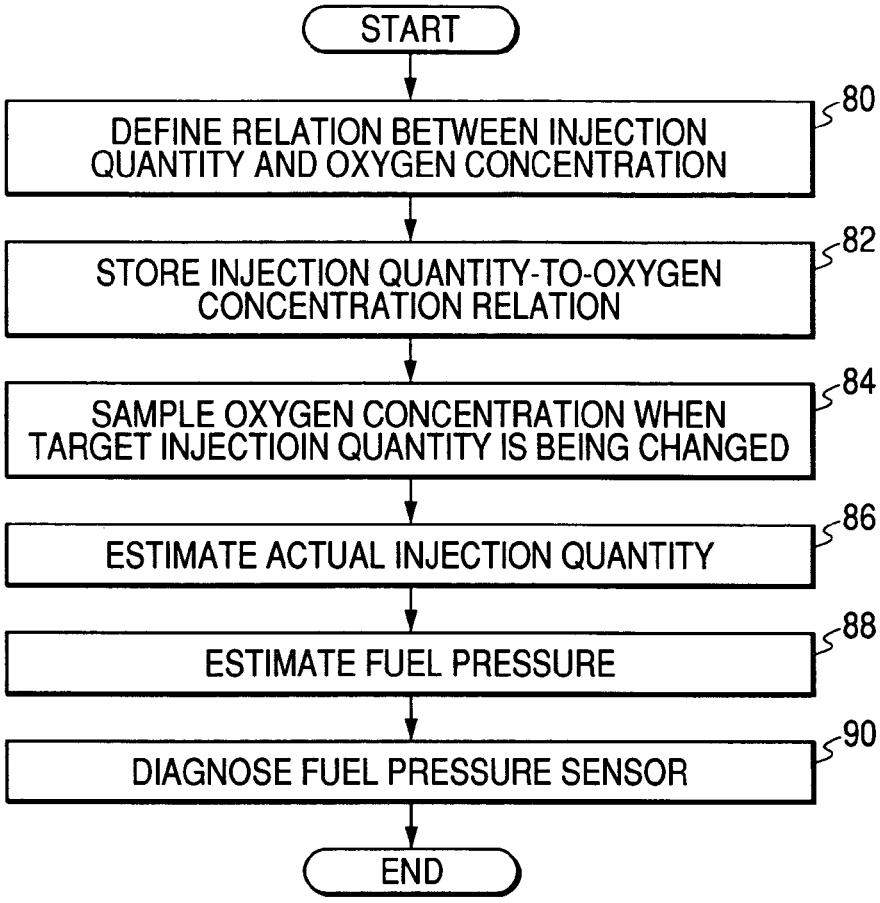
FIG. 10 is a flowchart of a diagnosis program to be executed by a fuel injection system of the fourth embodiment to diagnose a fuel pressure sensor.

FIG. 10 is a flowchart of a diagnosis program to be executed by the ECU 30 to diagnose the fuel pressure sensor 20. The diagnosis program is performed after the diesel engine is assembled or produced.

Figure 11:
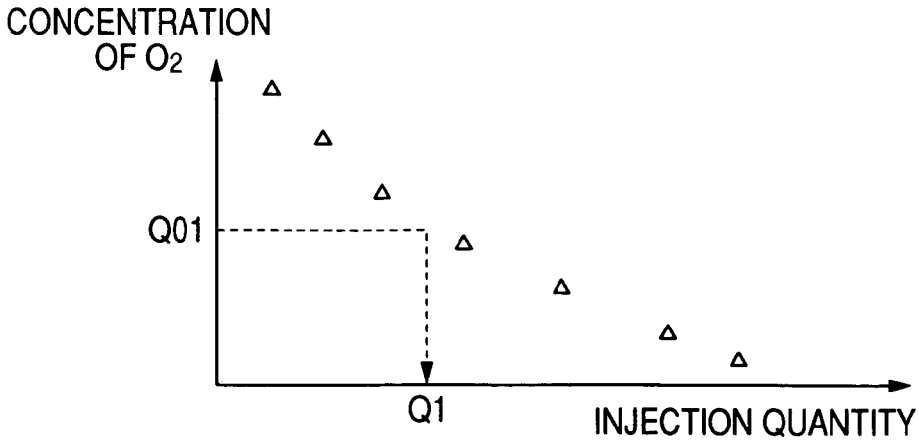
FIG. 11 is a graph which shows a relation between the concentration of oxygen contained in exhaust emissions of an engine and the quantity of fuel injected into the engine which is used to estimate the pressure in a common rail.

First, in step 80, the engine is started experimentally. The relation between the quantity of fuel injected actually into the engine and the concentration of oxygen ($O_2$) contained in exhaust gas emitted from the engine is sampled. Specifically, the quantity of fuel injected from fuel injectors into the engine and the concentration of oxygen ($O_2$) contained in exhaust gas, as measured by an oxygen sensor, are plotted, as demonstrated in FIG. 11.

Next, the routine proceeds to step 82 wherein the injection quantity-to-oxygen concentration relation, as defined in step 80, is stored in the memory of the ECU 30 of the fuel injection system of the vehicle in which the engine is to be mounted.

A sequence of following steps 84 to 90 are performed in a cycle in the ECU 30 after the engine is mounted in the vehicle. First, in step 84, the concentration of oxygen is sampled by the oxygen sensor 26 while a target quantity of fuel injected into the engine is being changed. The routine proceeds to step 86 wherein the quantity of fuel injected actually into the engine is estimated from the concentration of oxygen, as measured by the oxygen sensor 26, by look-up using the injection quantity-to-oxygen concentration relation, as derived in step 80. For example, as demonstrated in FIG. 11, when the concentration of oxygen has a value Q01, the quantity Q1 of fuel injected into the engine is estimated.

The routine proceeds to step 88 wherein the value of pressure of fuel in the common rail 10 is calculated by looking up a map table based on the injected quantity of fuel, as determined in step 86, and a target injection period, as commanded by the ECU 30, during which each of the fuel injectors 14 sprayed the fuel into the engine in step 84. The map table is stored in the ECU 30 for use in determining a target injection period based on a target quantity of fuel to be injected into the engine and the pressure of fuel in the common rail 30.

The routine proceeds to step 90 wherein the pressure in the common rail 10, as derived in step 88, is compared with an output of the fuel pressure sensor 20 used by the ECU 30 to determine the target injection period, as referred to in step 88 to diagnose the fuel pressure sensor 20.

Figure 12:
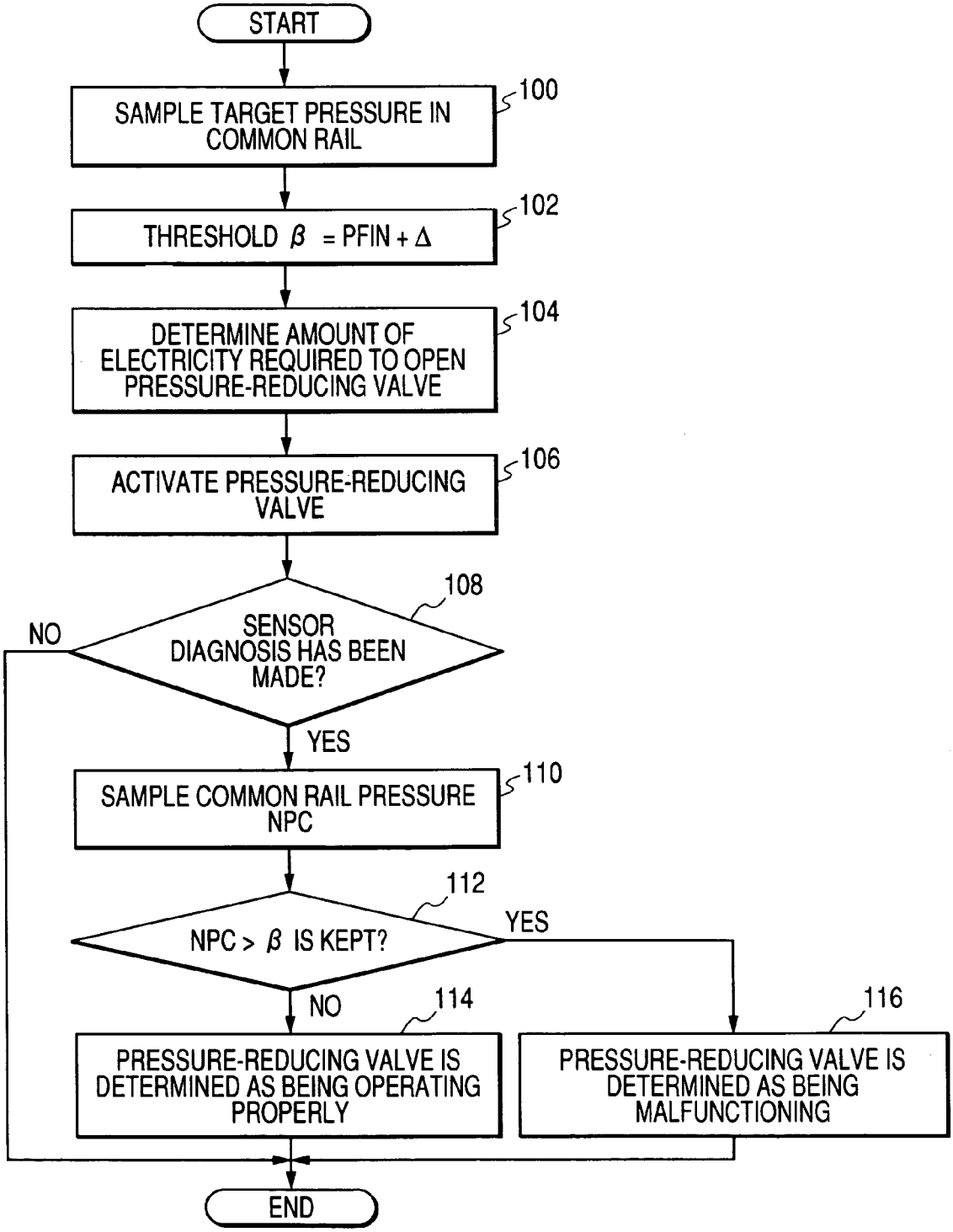
FIG. 12 is a flowchart of a program to be executed to diagnose a pressure-reducing valve in the fourth embodiment of the invention.

FIG. 12 is a flowchart of a program to be executed by the ECU 30 at given intervals to diagnose the pressure-reducing valve 18.

After entering the program, the routine proceeds to step 100 wherein a target pressure in the common rail 10 is sampled. The target pressure is determined in another program by the ECU 30 based on the position of an accelerator pedal of the vehicle (i.e., a pedal effort) and the target quantity of fuel to be injected into the engine.

The routine proceeds to step 102 wherein a threshold β that is a lower limit of the pressure in the common rail 10 serving to open the pressure-reducing valve 18 is determined by adding the value Δ, as referred to in FIG. 9(*b*), to the target pressure in the common rail 10.

The routine proceeds to step 104 wherein the amount of electric power which is to be supplied to the pressure-reducing valve 18 and required to bring the level of pressure in the common rail 10 acting on the pressure-reducing valve 18 into agreement with the threshold β is determined using the relation, as referred to in FIG. 9(*a*).

The routine proceeds to step 106 wherein the amount of electric power, as determine in step 104, is supplied to the pressure-reducing valve 18 to open it.

The routine proceeds to step 108 wherein it is determined whether the diagnosis that the pressure-reducing valve 18 is operating normally has been made in step 90 or not. If a YES answer is obtained, then the routine proceeds to step 110 wherein a common rail pressure NPC that is the pressure in the common rail 10, as measured by the fuel pressure sensor 20, is sampled.

The routine proceeds to step 112 wherein it is determined whether the common rail pressure NPC is kept greater than the threshold β for a given period of time or not. Specifically, when an actual pressure on the common rail 10 is greater than the threshold β, the pressure-reducing valve 18 is opened to decrease the pressure in the common rail 10. Therefore, the above period of time is determined based on the time which is expected to be required by the pressure in the common rail 10 to drop below the threshold β after the pressure-reducing valve 18 is opened. When the common rail pressure NPC is kept greater than the threshold β for the given period time, it is determined in step 116 that the pressure-reducing valve 18 is malfunctioning. Alternatively, when the common rail pressure NPC is not kept greater than the threshold β for the given period time, it is determined in step 114 that the pressure-reducing valve 18 is operating properly.

If a NO answer is obtained in step 108 meaning that the diagnosis that the pressure-reducing valve 18 is operating normally has not been made in step 90 or after step 114 or 116, the routine terminates.

The fuel injection system of each of the above embodiments may be modified below.

In the first embodiment, when the ignition switch 40 was turned off and it was determined in a previous cycle of the program of FIGS. 3(*a*) and 3(*b*) that the fuel pressure sensor 20 is operating properly, the result of diagnosis of the pressure-reducing valve 18 made in this program cycle when the ignition switch is turned off is settled ultimately (see steps 44 and 46 in FIG. 3(*a*)). However, during an interval between the previous turning off and current turning off the ignition switch 40, a failure in the operation of the pressure-reducing valve 18 may occur. In such an event, there is concern in the program of FIGS. 3(*a*) and 3(*b*) that the failure in operation of the fuel pressure sensor 20 results in an erroneous decision that the pressure-reducing valve 18 is malfunctioning.

The deterioration in reliability of the diagnosis of the pressure-reducing valve 18 arising from the above factor may be avoided by erasing data on the result of the diagnosis of the pressure-reducing valve in step 50 of FIG. 3(*a*) or alternatively by eliminating steps 12, 39-52, and 32. In the latter case, each time the ignition switch 40 is turned off, a temporal diagnosis of the pressure-reducing valve 18 is made. Subsequently, the fuel pressure sensor 20 is diagnosed. If it is diagnosed that the fuel pressure sensor 20 is operating properly, the temporal diagnosis of the pressure-reducing valve 18 is settled ultimately.

The fuel injections system of the third embodiment may alternatively be designed to perform the program of FIG. 6.

In each of the first, second, and third embodiment, the diagnosis of the fuel pressure sensor 20 may be made immediately after the ignition switch 40 is turned off. Usually, immediately after the ignition switch 40 is turned off, the pressure of fuel in the common rail 10 is expected to be near the atmospheric pressure. It is, thus, possible to monitor whether an output of the fuel pressure sensor 20 indicates the pressure level near the atmospheric pressure or not to diagnose the fuel pressure sensor 20.

The diagnosis of the fuel pressure sensor 20, as illustrated in FIG. 10, may be made in the fuel injection system of each of the first to third embodiment.

The fuel injection system of the fourth embodiment works to use the relation between the quantity of fuel injected into the engine and the concentration of oxygen contained in exhaust emissions of the engine to estimate an actual level of pressure in the common rail 10 for diagnosing the fuel pressure sensor 20, but however, may be designed to estimate the quantity of fuel sprayed into the engine based on an increase in speed of an output shaft of the engine when a single jet of the fuel is injected into the engine during deceleration of the vehicle in a fuel cut mode and calculate the pressure in the common rail 10 based on the estimated quantity of fuel and an injection period for which the single jet of the fuel is injected into the engine. The relation between the single jet of fuel and the quantity of fuel injected into the engine is, for example, taught in Japanese Patent First Publication No. 2005-36788, the disclosure of which is incorporated herein by reference.

The diagnosis of the fuel pressure sensor 30 in the fourth embodiment may be made in the fuel injection system of each of the first to third embodiment.

The fuel injection system of the fourth embodiment may be designed to diagnose the pressure-reducing valve 18 by turning off the pressure-reducing valve 18 after the ignition switch 40 is turned off.

The fuel injection system of each of the embodiments may be equipped with two fuel pressure sensors 20 and designed to monitor an output of one of the fuel pressure sensors 20 to diagnose the other fuel pressure sensor 20.

The diagnosis of the pressure-reducing valve 18 may alternatively be made in a manner different from those illustrated in FIGS. 4, 6, and 12. For instance, in the case where the diagnosis of the fuel pressure sensor 20 is made in the manner, as illustrated in FIG. 10, the ECU 30 may work to turn off the pressure-reducing valve 18 when the ignition switch 40 is turned off and determine that the pressure-reducing valve 18 is malfunctioning when an output of the fuel pressure sensor 20 shows a pressure level higher than the atmospheric pressure after the elapse of time which is expected to be required by the pressure in the common rail 10 to drop down to the atmospheric pressure under the assumption that the pressure-reducing valve 18 is now placed in the open state.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. A fuel injection system for an internal combustion engine comprising:

an accumulator storing therein fuel under a given pressure which is to be injected into an engine;

a fuel pump working to pressurize and supply the fuel to said accumulator;

a fuel injector working to inject the fuel in said accumulator into the engine;

a fuel pressure sensor working to measure a pressure of the fuel in said accumulator to output a signal indicative thereof;

a pressure-reducing valve working to drain the fuel from said accumulator to a fuel tank to decrease the pressure of the fuel in said accumulator; and a controller working to monitor the signal outputted from said fuel pressure sensor to control the pressure in said accumulator, said controller including a first diagnostic circuit and a second diagnostic circuit, the first diagnostic circuit working to diagnose said fuel pressure sensor, the second diagnostic circuit working to monitor a behavior of the pressure in said accumulator, as measured by said fuel pressure sensor when activating said pressure-reducing valve to diagnose said pressure-reducing valve, when a first condition in which the monitored behavior of the pressure in said accumulator is different from a behavior of the pressure in said accumulator, as expected when said pressure-reducing valve is operating properly, and a second condition in which said first diagnostic circuit has diagnosed that said fuel pressure sensor is operating properly are both met, said second diagnostic circuit determining that said pressure-reducing valve is failing in operation thereof; and wherein the second diagnostic circuit works to open said pressure-reducing valve upon turning off of an ignition switch of a vehicle in which the engine is mounted and diagnose whether said pressure-reducing valve is operating properly or not based on the behavior of the pressure in said accumulator arising from opening of said pressure-reducing valve and a result of diagnosis of said fuel pressure sensor made by the first diagnostic circuit.

2. A fuel injection system as set forth in claim 1, wherein the first diagnostic circuit works to compare a value of the pressure in said accumulator, as measured by said fuel pressure sensor after elapse of a given period of time following the turning off of the ignition switch, with an atmospheric pressure to diagnose whether said fuel pressure sensor is operating properly or not, and wherein said second diagnostic circuit also works to make a temporal diagnosis of said pressure-reducing valve based on the behavior of the pressure in said accumulator arising from the opening of said pressure-reducing valve, when a condition in which the temporal diagnosis that said fuel pressure sensor is operating properly is made and the second condition are both met, said second diagnostic circuit determining that said pressure-reducing valve is failing in operation thereof.

3. A fuel injection system as set forth in claim 2, wherein said controller is designed to sample a temperature of a coolant of the engine, and wherein said first diagnostic circuit works to extend the given period of time as the temperature of the coolant decreases.

4. A fuel injection system as set forth in claim 2, wherein said controller is designed to sample a temperature of the fuel, and wherein said first diagnostic circuit works to extend the given period of time as the temperature of the fuel decreases.

5. A fuel injection system as set forth in claim 2, wherein the second diagnostic circuit works to use a given criterion for making the temporal diagnosis that said pressure-reducing valve is failing in operation thereof and vary the given criterion as a function of the pressure in said accumulator.

6. A fuel injection system as set forth in claim 2, wherein said controller is designed to sample a temperature of a coolant of the engine, and wherein the second diagnostic circuit works to use a given criterion for making the temporal diagnosis that said pressure-reducing valve is failing in operation thereof and vary the given criterion as a function of the temperature of the coolant.

7. A fuel injection system as set forth in claim 2, wherein said controller is designed to sample a temperature of the fuel, and wherein the second diagnostic circuit works to use a given criterion for making the temporal diagnosis that said pressure-reducing valve is failing in operation thereof and vary the given criterion as a function of the temperature of the fuel.

8. A fuel injection system as set forth in claim 2, wherein after the turning off of the ignition switch, said second diagnostic circuit works to make the temporal diagnosis of said pressure-reducing valve before the elapse of the given period of time after when the value of the pressure in said accumulator, as measured by said fuel pressure sensor, is sampled by the first diagnostic circuit for diagnosing said fuel pressure sensor, and wherein when the condition in which the temporal diagnosis that said fuel pressure sensor is operating properly is made and the second condition are both met, said second diagnostic circuit determines that said pressure-reducing valve is failing in operation thereof after the first diagnostic circuit diagnoses whether said fuel pressure sensor is operating properly or not.

9. A fuel injection system as set forth in claim 8, wherein when the second diagnostic has made the temporal diagnosis that said pressure-reducing valve is failing in operation thereof, the first diagnostic circuit works to extend the given period of time to be longer than that when the second diagnostic has made the temporal diagnosis that said pressure-reducing valve is operating properly.

10. A method for fuel injection in an internal combustion engine, said method comprising:

pressurizing and supplying fuel to an accumulator where it is stored under a given pressure for injection into an engine;

injecting fuel from said accumulator into the engine;

measuring pressure of the fuel in said accumulator and outputting a signal indicative thereof;

draining fuel from said accumulator to a fuel tank via a pressure-reducing valve to decrease the pressure of fuel in said accumulator; and monitoring the output fuel pressurization to control the pressure in said accumulator;

diagnosing a fuel pressure sensor used in said measuring step;

monitoring a behavior of the pressure in said accumulator, as measured by said fuel pressure sensor when activating said pressure-reducing valve to diagnose said pressure-reducing valve when a first condition in which the monitored behavior of the pressure in said accumulator is different from a behavior of the pressure in said accumulator, as expected when said pressure-reducing valve is operating properly, and a second condition in which said diagnosing step has determined that said fuel pressure sensor is operating properly are both met, determining that said pressure-reducing valve is failing in operation; and wherein said pressure-reducing valve is opened upon turning off of an ignition switch of a vehicle in which the engine is mounted and diagnosing whether said pressure-reducing valve is operating properly or not based on behavior of the pressure in said accumulator arising from opening of said pressure-reducing valve and a result of diagnosis of said fuel pressure sensor.

11. A method as in claim 10 wherein:

a value of the pressure in said accumulator, as measured by said fuel pressure sensor after elapse of a given period of time following the turning off of the ignition switch, is compared with an atmospheric pressure to diagnose whether said fuel pressure sensor is operating properly or not, and a temporal diagnosis of said pressure reducing valve is made based on the behavior of the pressure in said accumulator arising from the opening of said pressure-reducing valve, when a condition in which the temporal diagnosis that said fuel pressure sensor is operating properly is made and the second condition are both met, determining that said pressure-reducing valve is failing in operation thereof.

12. A method as in claim 11 wherein a temperature of a coolant of the engine is sampled, and wherein the given period of time is extended as the temperature of the coolant decreases.

13. A method as in claim 11 wherein a temperature of the fuel is sampled, and wherein the given period of time is extended as the temperature of the fuel decreases.

14. A method as in claim 11 wherein given criterion is used for making the temporal diagnosis that said pressure-reducing valve is failing in operation thereof and the given criterion is varied as a function of the pressure in said accumulator.

15. A method as in claim 11 wherein a temperature of a coolant of the engine is sampled and wherein a given criterion is used for making the temporal diagnosis that said pressure-reducing valve is failing in operation thereof and the given criterion is varied as a function of the temperature of the coolant.

16. A method as in claim 11 wherein a temperature of the fuel is sampled, and wherein a given criterion is used for making the temporal diagnosis that said pressure-reducing valve is failing in operation thereof and the given criterion is varied as a function of the temperature of the fuel.

17. A method as in claim 11 wherein after the turning off of the ignition switch, the temporal diagnosis of said pressure-reducing valve is made before the elapse of the given period of time after which the value of the pressure in said accumulator, as measured by said fuel pressure sensor, is sampled for diagnosing said fuel pressure sensor, and wherein when the condition in which the temporal diagnosis that said fuel pressure sensor is operating properly is made and the second condition are both met, it is determined that said pressure-reducing valve is failing in operation thereof after it has been diagnosed whether said fuel pressure sensor is operating properly or not.

18. A method as in claim 17 wherein when the temporal diagnosis that said pressure-reducing valve is failing in operation thereof has been made, the given period of time is extended to be longer than that when the temporal diagnosis has been made that said pressure-reducing valve is operating properly.

* * * * *